US007305209B2

(12) United States Patent
Takata et al.

(10) Patent No.: US 7,305,209 B2
(45) Date of Patent: Dec. 4, 2007

(54) SHEET TRANSPORT DEVICE, IMAGE READING DEVICE, AND IMAGE FORMING DEVICE

(75) Inventors: Sohichi Takata, Nara (JP); Kazuo Nakamura, Kashiba (JP); Hiroyuki Nagao, Nara (JP); Takasi Nisida, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 134 days.

(21) Appl. No.: 10/851,163

(22) Filed: May 24, 2004

(65) Prior Publication Data

US 2004/0240916 A1 Dec. 2, 2004

(30) Foreign Application Priority Data

May 27, 2003 (JP) ..... 2003-149729

(51) Int. Cl.
*G03G 15/00* (2006.01)

(52) U.S. Cl. ..... 399/395; 399/367; 400/579

(58) Field of Classification Search ..... 399/16, 399/17, 395, 367; 400/579, 630, 630.2, 632
See application file for complete search history.

(56) References Cited

U.S. PATENT DOCUMENTS

| | | | | |
|---|---|---|---|---|
| 6,011,948 | A * | 1/2000 | Amano et al. | 399/395 |
| 6,059,285 | A * | 5/2000 | Suga et al. | 271/228 |
| 6,106,086 | A * | 8/2000 | Nishii | 347/3 |
| 7,063,472 | B2 * | 6/2006 | Matsuda et al. | 400/579 |
| 2002/0054382 | A1 * | 5/2002 | Nanno | 358/498 |

FOREIGN PATENT DOCUMENTS

| | | | |
|---|---|---|---|
| JP | 58-108863 | A | 6/1983 |
| JP | 2003212394 | A * | 7/2003 |

* cited by examiner

*Primary Examiner*—Ren Yan
(74) *Attorney, Agent, or Firm*—Birch, Stewart, Kolasch & Birch, LLP

(57) ABSTRACT

In an image reading device of a multifunction device, a sheet transport device is provided with a resist roller and a resist roller in a sheet transport path extending from a document tray on which a document as a sheet is placed to an image reading region where reading of a document is performed. The resist roller and a roller correct skewing of the sheet and delivers the sheet to a transport path extending to the resist roller placed in front of the image reading region. After having been corrected once in the resist roller, the document is transported to the resist roller, so that it is possible to reliably correct skewing of the sheet with the resist roller and the roller.

8 Claims, 6 Drawing Sheets

SHEET TRANSPORT DEVICE, IMAGE READING DEVICE, AND IMAGE FORMING DEVICE

This Nonprovisional application claims priority under 35 U.S.C. § 119(a) on patent application Ser. No. 2003/149729 filed in Japan on May 27, 2003, the entire contents of which are hereby incorporated by reference.

FIELD OF THE INVENTION

The present invention relates to a sheet transport device which transports a sheet such as document or printing paper, an image reading device, and an image forming device.

BACKGROUND OF THE INVENTION

In recent years, an image reading device including a sheet transport device capable of transporting a plurality of sheets like documents to an image reading section of an image reading device and causing the image reading section to sequentially read the sheets has been used.

In transporting a sheet, the sheet transport device may transport a skewed sheet (skews the sheet), without transporting a sheet straight. For example, when the image reading section reads an image on the skewed sheet, the image is read in a displaced state, or a portion of the image on the sheet becomes unreadable. This would cause degradation in quality of reading.

In view of this, the sheet transport device is provided with a resist section for straightening a skew of the sheet at the position where a sheet is delivered to the image reading section. By using this resist section, a timing of reading the sheet can be adjusted.

Note that, Japanese Laid-Open Patent Application No. 108863/1983 (Tokukaisho 58-108863; published on Jun. 29, 1983) discloses a two-sided recording system having such an arrangement in which two printing sections are provided in a transport path for documents, and each of the printing sections is provided with a resist section only on the front end.

However, in the conventional arrangement, there is the possibility that a skew caused would become so large to be straightened sufficiently.

The skew of the sheet transported occurs when the sheet is picked up from a tray or during a period of time in which a sheet is being transported in the transport path.

For example, a long transport path for sheets causes a skew due to a size error of a transport member (transport roller) provided in the transport path and instability (variations) of contact load of a transport guide.

Further, a pickup roller of such a shape that the roller only comes into contact with the central part of the sheet is used so that sheets of any sizes can be picked up from a tray. With this arrangement, picking-up operation becomes unstable depending on a state where the sheet is placed in the tray and variations in contact load (state) between sheets, resulting in the occurrence of a skew.

While a greater number of sheets can be placed once in a tray, reduction in size of a main unit of a device is required. In view of the circumstances, such a sheet transport device is used that a transport path through which a sheet passes from a tray to an image reading section is curved to attain the reduction in size of the main unit of the device. In such an arrangement in which the transport path is curved, since a sheet is transported in a bowed state, a skew of the sheet is more likely to occur.

For this reason, when a sheet reaches the position of the resist section placed in the front of the image reading section, a skew has already become large, which causes the possibility that the skew could not be sufficiently straightened at the resist section.

The present invention is attained in view of the above-mentioned problems, and provides a sheet transport device which can reliably straighten skewing of a sheet to be transported, an image reading device, and an image forming device.

SUMMARY OF THE INVENTION

In order to solve the above problem, in a sheet transport device according to an embodiment of the present invention includes: a transport path through which a sheet is transported, the transport path including: a processing region for a processing section which performs a predetermined process with respect to the sheet; and a transport region for transporting the sheet to the processing region; a first resist section, provided in the transport region, correcting skewing of the sheet and delivering the sheet to the processing section in accordance with a timing of the process in the processing section; and a second resist section, provided in the transport region of the transport path, correcting skewing of the sheet, the sheet having been delivered from the second resist section is transported to the first resist section via only the transport region of the processing region and the transport region.

The resist section (first resist section, second resist section) is a pair of rollers placed opposite to each other, for example. In the state where the rotation of the pair of rollers is stopped, one side of the leading end of the sheet is brought along a joint of the rollers by meeting the sheet with the joint of the rollers. This makes it possible to correct a displacement of the document in the sheet transport direction, thereby straightening skewing of the sheet. The sheet can be transported with the pair of rollers rotated at a proper timing. Note that, the arrangement of the resist section is not limited to this arrangement, and other arrangement may be adopted.

Further, the processing section is, for example, an image forming section which performs printing on the sheet. In this case, the sheet corresponds to a printing sheet for printing (sheet of paper). Further, the processing section is, for example, an image reading section which reads an image of the sheet. In this case, the sheet corresponds to a document on which images are recorded.

This sheet transport device includes, in the transport path through which the sheet is transported, the second resist section, the first resist section, and the processing section which performs a predetermined process with respect to the sheet. In the transport path, the second resist section, the first resist section, and the processing section are provided in this order along the sheet transport direction. The sheet transport device supplies the sheet having been subjected to skewing correction in the second resist section to the first resist section. Therefore, in the sheet supplied to the first resist section, the amount of displacement in the skewed sheet is not so large. Therefore, it is possible to reliably correct skewing of the sheet in the first resist section and then deliver the sheet to the processing section at a desired timing.

Here, the foregoing sheet transport device may include a sheet transport member for transporting the sheet in the transport path extending from the second resist section to the first resist section and the processing section. The sheet transport member is, for example, a pair of rollers transporting the sheet in such a manner so as to rotate themselves with the sheet sandwiched therebetween. Note that, the arrangement of the sheet transport member, which is not limited to this arrangement, may be any arrangement provided a driving force is given to the sheet for transporting. With the arrangement including the sheet transport member, the sheet delivered from the second resist section is transported to the first resist section and the processing section by the sheet transport member. That is, the second resist section is a resist section not directly supplying the sheet to the processing section.

The foregoing sheet transport device includes only the transport region in the transport path extending from the second resist section to the first resist section and the processing section, not including the processing region for the processing section.

Thus, the first resist section supplies the sheet to the processing section in accordance with a timing of the process in the processing section so that the processing section performs a proper process with respect to the sheet. The first resist section reliably corrects skewing of the sheet, so that the processing section can perform a proper process. If the processing section is, for example, an image forming section which performs printing on the sheet, no displacement of the image printed on the sheet occurs. Further, if the processing section is, for example, an image reading section which reads an image of the sheet, no skew of the read image occurs.

Moreover, the foregoing sheet transport device may have an arrangement in which another resist section, in addition to the first resist section and the second resist section, is provided in the transport region of the transport path.

According to the above arrangement, even when there is a long transport distance to the processing section performing a process to the sheet, and even when a resisting force opposing transport of the sheet unstably acts on the sheet being transported, a plurality of resist sections provided in the transport path extending to the processing section correct a skew of the sheet caused during the transport of the sheet for a plurality of times, so that the skew of the sheet supplied to the resist section in front of the processing section (first resist section) can be reduced to an allowable level of skew that can be corrected by the first resist section. Therefore, after the skew of the sheet is completely straightened, a process can be performed with respect to the sheet.

Note that, the foregoing sheet transport device can be expressed as a sheet supply path having: a sheet containing section which contains a plurality of sheets in the stacked state; a sheet supply and transport section which comes into contact with the plurality of sheets, and supplies and transports a sheet from the plurality of sheets to the transport path; and a transport section which transports the sheet to the processing section which processes the sheet, the sheet supply path being provided with a plurality of resist sections.

Further, the foregoing sheet transport device can be expressed as a sheet transport device having an arrangement in which in addition to the first resist section which directly supplies the sheet to the processing section which performs a predetermined process to the sheet, the second resist section which corrects skewing of the sheet and supplies the sheet to the first resist section is provided in the transport path through which only the sheet is transported.

Still further, the foregoing sheet transport device can be expressed as a sheet transport device having an arrangement in which the resist section (second resist section) which corrects skewing of the sheet is provided in the transport path through which only the sheet is transported, on the upstream side of a position in front of Oust before) the processing section which performs a predetermined process with respect to the sheet, in the sheet transport direction.

Yet further, the foregoing sheet transport device can be expressed as a sheet transport device having an arrangement in which in the transport path through only the sheet is transported, the first resist section which directly supplies the sheet to the processing section which performs a predetermined process to the sheet, and the second resist section which corrects skewing of the sheet and supplies the sheet to the first resist section are provided, the sheet transport device not including the processing section and another processing section between the first resist section and the second resist section in the transport path.

The foregoing sheet transport device has an arrangement in which the first resist section corrects skewing of the sheet and adjust a supply timing to the processing section for the sheet, and the second resist section corrects at least skewing of the sheet.

According to this arrangement, a process of adjusting the supply timing of the sheet to a process timing in the processing section is performed by the resist section (first resist section) provided in front of the processing section, so that a resist section (second resist section) other than the first resist section can control timing adjustment roughly to some extent. For example, in the second resist section, it is considered that the second resist section eliminates the need for the process of adjusting the supply timing of the sheet to the process timing in the process section (Especially, it is not necessary to perform the process). Note that, each of the resist section is provided with at least a function of straightening a skew of the sheet, so that it is possible to reliably straighten a skew of the sheet.

Note that, the foregoing sheet transport device can be expressed as a sheet transport device having an arrangement in which the second resist section at least functions to straighten skews of the sheets, and the first resist section functions to straighten skews of the sheets and to adjust the supply timing of supplying the sheets to the processing section.

In order to solve the above problem, in a sheet transport device according to an embodiment of the present invention, in the foregoing arrangement, the transport path includes a curved section having a curved shape, the curved section changing a transport direction of the sheet to be transported, and the curved section is provided between the first resist section and the second resist section.

According to the above arrangement, the second resist section and the first resist section are provided at an entrance and an exit of the curved section (curved transport path), respectively, so that a skew can be straightened in the second resist section before the sheet enters the curved section. This makes it possible to insert the sheet without displacement into the curved section which is more likely to become unstable due to a large transport load of the sheet. Therefore, the skew does not become greater when the sheet is transported through the curved section. Moreover, in the curved section which is more likely to become unstable due to a large transport load, even if a skew occurs, the first resist section can straighten the skew. Therefore, it is possible to perform a proper process without causing displacement to the sheet.

Note that, the foregoing sheet transport device can be expressed as a sheet transport device having an arrangement in which the transport path is provided with a curved transport path which changes the transport direction, the resist means is made up of first resist means and second resist means, and the curved transport path is provided between the first resist means and the second resist means.

In order to solve the above problem, in a sheet transport device according to the present invention, in the foregoing arrangement, the first resist section is provided on a downstream side of the curved section in the transport direction of the sheet, at a distance from the curved section, and the second resist section is provided on an upstream side of the curved section in the transport direction of the sheet, at a position just before the curved section.

According to this arrangement, the first resist section is provided at a distance from the curved section, so that an area between the curved section and the first resist section can be an area where a skew of the sheet is straightened. This facilitates forming bending of sheet, and the bending makes it possible to easily provide a force for straightening a skew of the sheet and a displacement. Therefore, it is possible to easily provide a sheet having no skews.

Further, the second resist section is provided at a position just before the curved section on the upstream side, so that the sheet whose skew is straightened in the second resist section is delivered to the curved section where a skew is more likely to occur, thereby reducing a skew caused in the curved section.

Note that, in the state where the sheet is transported through the curved section, a force for straightening a skew of the sheet (displacement) cannot be provided to the sheet due to firmness of the sheet curved.

Further, the foregoing sheet transport device can be expressed as a sheet transport device having an arrangement in which the second resist section is located at the entrance of the curved transport path, and the first resist section is located at a distance from the exit of the curved transport path.

In order to solve the problem, an image reading device according to an embodiment of the present invention includes any one of the foregoing sheet transport devices, the processing section being an image reading section which reads an image of the sheet.

According to this arrangement, it is possible to obtain the foregoing effect in the image reading device and to perform reading with high quality.

In order to solve the problem, an image forming device according to an embodiment of the present invention includes any one of the foregoing sheet transport devices, the processing section being an image forming section which forms an image on the sheet.

According to this arrangement, it is possible to obtain the foregoing effect in the image forming device and to perform image forming with high quality.

In order to solve the above problem, a sheet transport device according to an embodiment of the present invention, which is connected to a processing device including a processing section which performs a predetermined process with respect to a sheet, includes: a transport path through which the sheet is transported to the processing section; and a primary resist section, provided in the transport path, correcting at least skewing of the sheet and adjusting a delivery timing of the sheet, and supplies the sheet to the processing section by means of the primary resist section, the sheet transport device including: a secondary resist section correcting skewing of the sheet, provided at an upstream position in a flow of the sheet with respect to the primary resist section in the transport path.

This sheet transport device is a separate device connected to the processing device having the processing section, and supplies the sheet from the transport path to the processing section. The sheet is supplied from the primary resist section which corrects at least skewing of the sheet and adjusts the delivery timing of the sheet to the processing device, in accordance with a timing of the process in the processing section.

The resist section (primary resist section, secondary resist section) is a pair of rollers placed opposite to each other, for example. In the state where the rotation of the pair of rollers is stopped, one side of the leading end of the sheet is brought along a joint of the rollers by meeting the sheet with the joint of the rollers. This makes it possible to correct a displacement of the document in the sheet transport direction, thereby straightening skewing of the sheet. The sheet can be transported with the pair of rollers rotated at a proper timing. Note that, the arrangement of the resist section is not limited to this arrangement, and other arrangement may be adopted.

Further, the processing section is, for example, an image forming section which performs printing on the sheet. In this case, the sheet corresponds to a printing sheet for printing (sheet of paper). Further, the processing section is, for example, an image reading section which reads an image of the sheet. In this case, the sheet corresponds to a document on which images are recorded.

The sheet transport device has the secondary resist section in the transport path, and skewing is corrected once in the secondary resist section in the midway of transport in the transport path. Therefore, the amount of displacement (skew) in the skewed sheet is not so large. Therefore, a skew occurring when this sheet is supplied to the primary resist section can be the amount of skew that can be reliably corrected by the primary resist section. This makes it possible to reliably correct skewing of the sheet and then deliver the sheet to the processing section, whereby the process in the processing section can be performed properly.

Further, by rotating the pair of rollers in the resist section at a proper timing (a timing associated with a start timing of the process), it is possible to deliver the sheet toward the processing section and to perform a proper process with respect to the sheet subjected to displacement correction.

Still further, for example, the above sheet transport device, in the foregoing arrangement, may be a sheet supply unit which includes a tray storing printing sheets for printing, is connected to the image forming device which performs printing on this printing sheet, and supplies printing sheets from the tray to the image forming device. In this case, the processing section which performs a predetermined process corresponds to the image forming section included in the image forming device.

Note that, in the above-arranged sheet transport device, for example, a sheet transport member (transport member) may be provided in a path extending from the secondary resist section to the primary resist section. That is, by the transport member provided in the transport path of the sheet transport device, or by the transport member provided in the processing device which is connected to this sheet transport device, the sheet may be transported from the secondary resist section to the primary resist section. The sheet transport member is, for example, a pair of rollers transporting the sheet in such a manner so as to rotate themselves with the sheet sandwiched therebetween. Note that, the arrangement of the sheet transport member, which is not limited to this arrangement, may be any arrangement provided a driving force is given to the sheet for transporting.

For a fuller understanding of the nature and advantages of the invention, reference should be made to the ensuing detailed description taken in conjunction with the accompanying drawings.

BRIEF DESCRIPTION OF THE DRAWINGS

FIG. 5(*b*) is a plane view illustrating the transport roller and one example of a driven roller used together with the transport roller.

FIG. 6(*b*) is a plane view illustrating one example of still another transport roller provided in the image forming device.

DESCRIPTION OF THE EMBODIMENTS

An image reading device according to an embodiment of the present invention includes a sheet transport device having a plurality of resist sections for correcting skewing of sheets in a sheet transport path. Further, an image forming device according an embodiment of to the present invention includes a sheet transport device having a plurality of resist sections in a sheet transport path. Further, a sheet supply device (sheet supply unit) as an example of a sheet transport device according to an embodiment of the present invention has a resist section in a transport path through which a sheet is transported to the image forming device. This makes it possible to reliably correct skewing of sheets.

The following will describe one embodiment of the present invention with reference to FIGS. 1 through 7.

Figure 2:
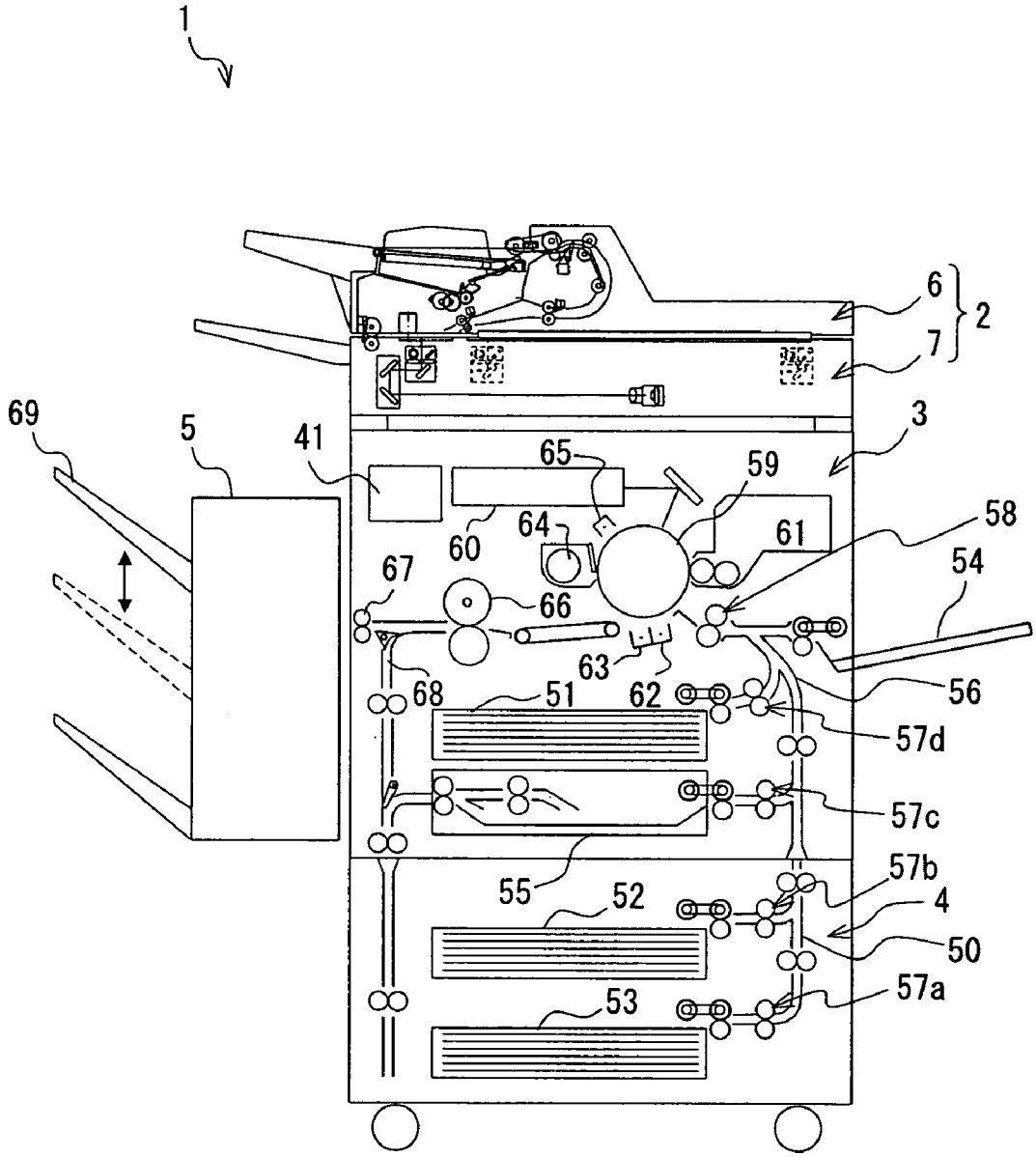
FIG. 2 is a cross-sectional diagram schematically illustrating one example of a multifunction device including an image forming device according to the present invention and a sheet transport device according to the present invention.

As schematically illustrated in FIG. 2, a multifunction device (image forming device, image reading device, and sheet transport device) 1 includes an image reading device (sheet transport device) 2, an image forming device (sheet transport device) 3, a sheet supply device (sheet transport device) 4, and a finishing device 5. The image reading device 2 is provided at the top of the multifunction device 1. The image forming device 3 is provided under the image reading device 2. The sheet supply device 4 is under the image forming device 3. The finishing device 5 is provided on the side surface of the image forming device 3.

The image reading device 2 is one for reading an image of a document (sheet). The image forming device 3 is one for printing an image of a document read by the image reading device 2 onto a sheet of paper (sheet). The image forming device 3 is also capable of printing, onto a sheet of paper, image data supplied from the outside of its main unit via an interface (not show). The sheet supply device 4, which is connected to the image forming device 3, is one for storing sheets of paper therein and supplying them to the image forming device 3. The finishing device 5 is one for performing finishing proces, such as stapling process, with respect to a sheet of paper subjected to printing by the image forming device 3.

Reading of a document by the image reading device 2 will be first described below, and printing by the image forming device 3 will be described thereafter.

Figure 1:
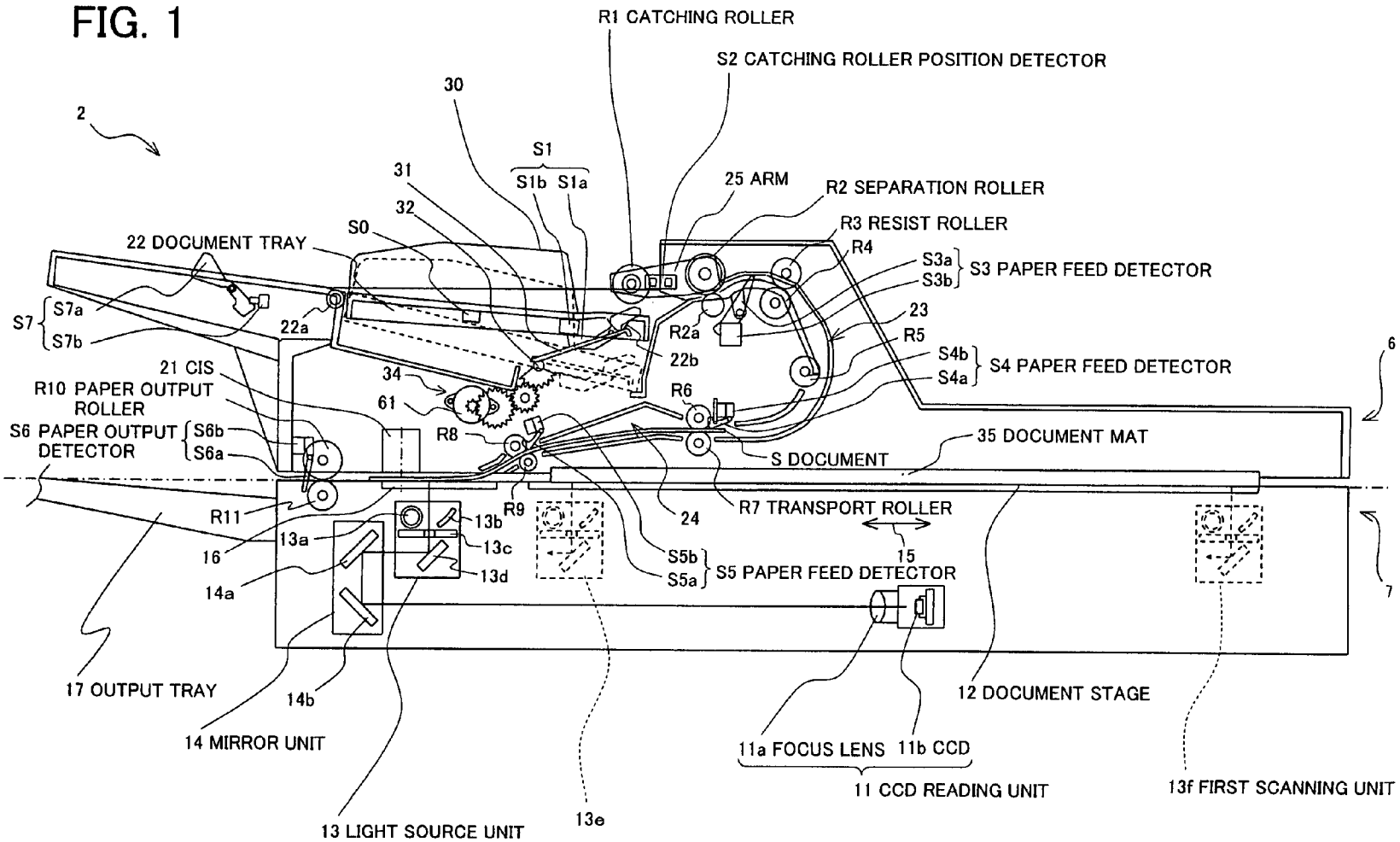
FIG. 1 is a cross-sectional diagram illustrating a schematic configuration of an image reading device including one example of a sheet transport device according to the present invention.

As schematically illustrated in FIG. 1, the image reading device 2 includes an ADF (Automatic Document Feeder) 6 at the top of its main unit and an optical reading section 7 at the bottom of its main unit. The image reading device 2 can read images of the document on the both sides by means of the optical reading section 7 and a reading section (CIS (Contact Image Sensor) 21) provided partially to the ADF 6.

Selectable modes in the image reading device 2 are the following three modes: static reading mode, scanning reading mode, and two-sided reading mode. The static reading mode is a mode of causing the optical reading section 7 to read an image of a document, such as a book, placed on a document stage 12. Both of the scanning reading mode and the two-sided reading mode are modes of reading images of documents placed on a document tray 22 while the ADF 6 automatically feeds the documents one by one. In the scanning reading mode, reading of a document is performed by means of the optical reading section 7. In the two-sided reading mode, an image of a document is read by means of both the optical reading section 7 and the CIS 21.

The ADF 6 is one for transporting a document from the document tray 22 provided at the top of the main unit of the image reading device 2 to an image reading region (processing region) constituted by the optical reading section 7 and the CIS 21 via a transport path where rollers R2-R9 for document transport are placed. In the optical reading section 7, a CCD reading unit 11 reads an image on one side of the document transported by the ADF 6 through a light source unit 13 and a mirror unit 14. Further, the CIS 21 provided in the ADF 6 reads an image on the other side of the document transported by the ADF 6. The following will describe transport of a document in the scanning reading mode and in the two-sided reading mode using the ADF 6, control operation in transporting, and, image reading in the image reading region.

As schematically illustrated in FIG. 1, the ADF 6 contains a transport path through which a document is transported and the document tray 22. The transport path includes therein rollers R2-R10 as transport means for transporting a document. This transport path includes a transport region where a document is transported and an image reading region where image reading process is performed with respect to the transported document. Here, the transport region, for example, corresponds to a continuous region extending from the position of the roller R2 to the positions of the rollers R8 and R9. On the downstream side of the rollers R8 and R9 in a transport direction of a document, an image reading region is located where an image reading process is performed with respect to a document. Further, the transport path of the ADF 6 contains a curved section 23 having a curved shape which changes the transport direction of a document to be transported.

The document tray 22 of the ADF 6 is an electric tray. The document tray 22 includes a document detector S1. The document detector S1 is an optical document detector made up of an actuator S1*a* and a sensor main unit S1*b*. The document detector S1 detects whether a document is placed on the document tray 22.

Also, the ADF 6 includes a catching roller R1 above the document tray 22. The catching roller R1 is supported so as to move up and down by an arm 25 provided to a cabinet of the ADF 6. The arm 25 is supported so as to pivot about a rotation axis of a separation roller R2 provided in the transport path of the ADF 6. The catching roller R1 comes into contact with the uppermost document placed on the document tray 22 under its own weight. The catching roller R1 is prevented by a stopper (not shown) from moving toward a position lower than a predetermined position, i.e. from moving toward a lower position than necessary.

The ADF 6 also includes a catching roller position detector S2 for detecting a displacement of the catching roller R1. The catching roller position detector S2 is realized by light sensor or the like. The catching roller position detector S2 detects a level of the catching roller R1 from an angle formed by the arm 25 moving in accordance with a projected section (not shown) which is provided to the arm 25. Note that, the arrangement of the catching roller position detector S2 is not limited to the arrangement in which the vertical position of the catching roller R1 is directly detected using the projected section provided to the arm 25. For example, an alternative arrangement may be the following arrangement: a movable connection section connected to the arm 25 is provided, and the catching roller position detector S2 is installed at a position apart from the arm 25 so that the catching roller position detector S2 performs the detection by means of the movable connection section.

Further, the document tray 22 of the ADF 6 includes a document regulation plate 30 for squaring up the edges of a document and regulating a placement position of a document. Further, the document tray 22 includes a first document size detector S0 and a second document size detector S7. The first document size detector S0 determines the breadth of a document (length in the direction orthogonal to the document transport direction) by detecting the position of the document regulation plate 30*a*. The second document size detector S7 is made up of an actuator S7*a* and a sensor main body S7*b*. The second document size detector S7 determines the length of a document (length in the document transport direction). The first document size detector S0 and the second document size detector S7 enable size determination of a document placed on the document tray 22. On the basis of a result of the size determination, the multifunction device 1 can select a size of a sheet of paper used for image forming.

When a document is placed on the document tray 22, the document tray 22 starts moving up at a predetermined timing. When the uppermost document of a batch of documents placed on the document tray 22 lifts the catching roller R1, the document tray 22 temporarily stops moving up and goes into a standby state. Thereafter, when the ADF 6 receives, for example, a document supply start signal from a control section (not shown) in the multifunction device 1, the ADF 6 sequentially supplies documents from a batch of documents to the transport path. Note that, when the multifunction device 1 is left in the foregoing standby state for a predetermined time period, the document tray 22 may be moved down to a predetermined position, for example. In such a manner, deformation of the catching roller R1 can be prevented. Note that, the arrangement of the document tray 22, which is not limited to an arrangement of temporarily moving down, and the document tray 22 may keep the standby state without moving down.

Further, for document reading operation, the document tray 22 is controlled by a control section (not shown) in accordance with a signal from the catching roller position detector S2 so that the top surface of a document placed on the document tray 22 is constantly at a predetermined level. The document tray 22 includes a rib 22*b*, an up and down plate 31, an up and down plate support axis 32, an up and down mechanism 34, and an up and down motor 61, which are used for up and down movement. The document tray 22 is supported in such a manner that the up and down plate 31 of the up and down mechanism 34 is brought into contact with the rib 22*b* formed at the bottom of the document tray 22 under the control of the control section. Normal and reverse rotations of the up and down motor 61 rotate the up and down plate support axis 32 via a transfer system such as a gear wheel. This rotates the up and down plate 31, whereby the document tray 22 moves up and down.

Documents caught by the rotating catching roller R1 are delivered one by one to the transport path of the ADF 6 in the state of being separated from one another by the separation rollers R2 and R2*a*. The separation roller R2 is provided opposite to the separation roller R2*a* including a torque limiter. With this arrangement, when a plurality of documents are caught by the catching roller R1, only the uppermost document (document facing the separation roller R2) is taken in by the separation rollers R2 and R2*a*. Therefore, it is possible to reliably transport documents one by one in a separated manner. Note that, instead of the separation roller R2*a*, a friction pad placed opposite to the separation roller R2 may be used.

In the transport path of the ADF 6, a paper feed detector S3 is provided on the downstream side of the separation rollers R2 and R2*a* in a transport direction of a document. The paper feed detector S3 is made up of an actuator S3*a* and a sensor main unit S3*b*. By using the paper feed detector S3, it is possible to determine whether documents are reliably transported one by one in a separated manner by the separation rollers R2 and R2*a*.

Further, in the transport path of the ADF 6, a pair of rollers realized by a resist roller R3 and a roller R4 are provided on the downstream side of the paper feed detector S3 in the document transport direction. On the downstream side of the resist roller R3 and the roller R4, a curved section 23 is provided. The resist roller R3 and the roller R4 are provided on the upstream side in the document transport direction, at the position just before the curved section 23. More specifically, the position immediately in front of the curved section 23 is, for example, a beginning part of the curved section 23.

The resist roller R3 and the roller R4 serve as a resist section (second resist section) correcting skewing of a document to be transported. That is, in the state where the resist roller R3 and the roller R4 are stopped rotational motion, a document transported from the separation rollers R2 and R2*a* meets with the resist roller R3 and the roller R4. Thus, skewing of a document can be corrected in such a manner that a leading end of a document in a bowed state is brought along a joint (nip part) of the resist roller R3 and the roller R4. Thereafter, the resist roller R3 and the roller R4 are rotated at a predetermined timing so that the document is delivered to the curved section 23.

The curved section 23 includes rollers R5, R6, and R7. In the transport path of the ADF 6, the curved section 23 corresponds to a region extending downstream of the resist roller R3 and the roller R4 in the document transport direction to a position in front of the rollers R6 and R7. In the curved section 23, a document delivered from the resist roller R3 and the roller R4 are transported through the roller R5, R6, and R7 to a resist/skew correction region 24.

Note that, the curvature of the curved section 23 is set to a curvature enabling a stable transport of all types of documents. That is, the curvature of the curved section 23 is a curvature enabling a smooth transport of the thickest document, in other words, the heaviest document among readable documents.

Further, the curved section 23 includes a paper feed detector S4. The paper feed detector S4 is made up of an actuator S4*a* and a sensor main unit S4*b*. The paper feed detector S 4 determines whether a document is smoothly transported in the curved section 23 by detecting output of the document from the curved section 23.

The document is delivered from the curved section 23 to the resist/skew correction region 24 through the roller R6 and R7. The resist/skew correction region 24 is a region provided in front of a pair of rollers (first resist section) realized by a resist roller R8 and a roller R9 so as to improve the effect of correcting skewing of a document. Thus, the resist roller R8 and the roller R9 are provided downstream in the document transport direction, at a distance from the curved section 23.

For example, as illustrated in FIG. 1, this resist/skew correction region 24 is provided so that a transported document S becomes substantially straight between the position where the rollers R6 and R7 are located and the position where the resist roller R8 and the roller R9 are located, and the document S does not come into contact with a guide surface of the transport path and becomes as free as possible.

Note that, a distance between the position where the transport rollers R6 and R7 are located and the position where the resist roller R8 and the roller R9 are located is provided so as to secure a minimum length in the transport direction of the smallest document among documents that can be processed using the ADF 6. That is, a document remaining inside the curved section 23 is shortened on its rear end, thereby enhancing the effect of smoothly correcting a skewed document.

Further, the ADF 6 is provided with a paper feed detector S5 in front of the resist roller R8 and the roller R9 located in the vicinity of an exit of the resist/skew correction region 24. The paper feed detector S5 includes an actuator S5*a* and a sensor main unit S5*b*.

When a document is transported from the curved section 23 to the resist/skew correction region 24, and the paper feed detector S5 detects the leading end of the document, a transport force from the upstream side is given to the document, using the transport rollers on the upstream side, including the transport rollers R6 and R7, in the state of stopping the resist roller R8 and the roller R9. This causes the leading end of the document to meets with a joint (nip section) of the resist roller R8 and the roller R9 for a predetermined period of time. In this manner, skew correction is performed.

After skewing of a document is corrected in the resist/skew correction region 24, the resist roller R8 and the roller R9 are rotated at a predetermined timing for restart of document transport. The document is transported to a first reading position (image reading region) where the document is scanned by exposure on its front surface (one side) by the light source unit 13. Then, the document is further transported to a second reading position (image reading region) where the document is read on its back surface (other side) by the CIS 21. More specifically, the resist roller R8 and the roller R9 restart document transport at a predetermined timing so as to adjust the timing at which the document is supplied to the image reading region. Thus, the document delivered from the resist roller R3 and the roller R4 both as a second resist section is delivered to an image reading region as a processing section by the resist roller R8 and the roller R9 as the first resist section.

The image reading device 2 reads images of the document on its front surface and back surface at the first and second reading positions, respectively. This reading operation will be described later. Thereafter, the document is outputted to an output tray 17 by output rollers R10 and R11. Note that, the output roller R11 is provided to the optical reading section 7, not to the ADF 6. Further, the output tray 17 is supported on the side surface of the image reading device 2 at a position lower than a document output point, thus facilitating output of a document. Further, the image reading device 2 is provided with a paper output detector S6 on the downstream side of the output rollers R10 and R11 in the transport direction. The paper output detector S6 is made up of an actuator S6*a* and a sensor main unit S6*b*. By using the paper output detector S6, a document output operation can be checked.

The image reading device 2 repetitively performs the aforementioned operation to read an image of each document until all the documents placed on the document tray 22 are gone. The documents subjected to reading are consecutively outputted on the paper output tray 17.

Figure 3:
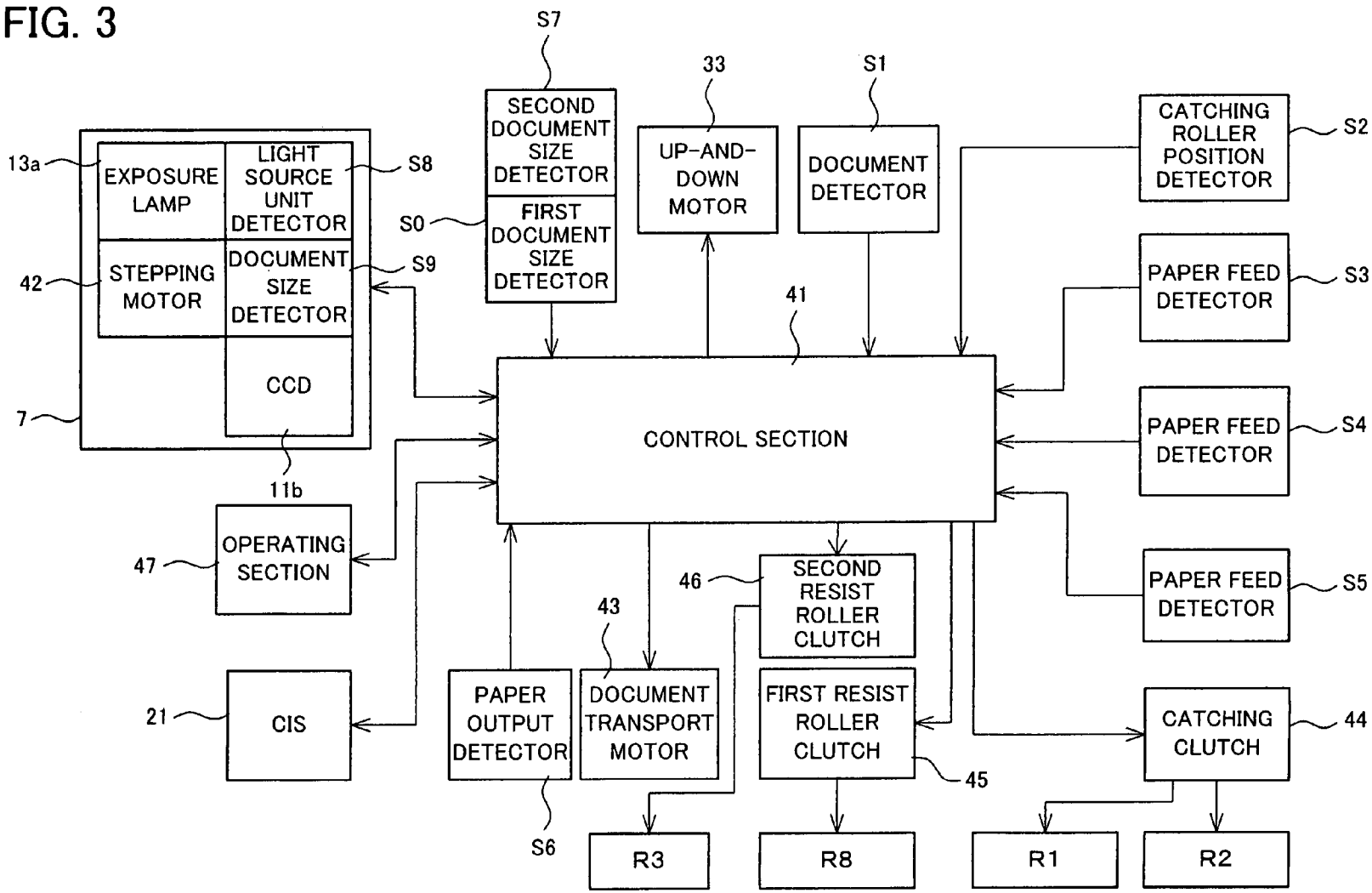
FIG. 3 is a block diagram illustrating a schematic configuration of the image reading device.

Here, as illustrated in FIG. 3, each of the means included in the image reading device 2 are controlled by a control section 41. The following will describe control operation by the control section 41 with reference to FIG. 3. Note that, in the present embodiment, the control section 41 is provided in the image forming device 3, and the control section 41 controls each of the means in the image reading device 2 by performing input and output of information. That is, the control section 41 is a control section for controlling the multifunction device 1. The control section 41 is realized by a microcomputer, or the like, and performs various control operations. Note that, the arrangement of the control section in the multifunction device 1 is not limited to the foregoing arrangement, and may be an arrangement in which an independent control section is provided in the image reading device 2.

The image reading device 2, as illustrated in FIG. 3, is provided with an operating section 47. The operating section 47 is realized by a liquid crystal touch panel, or the like. The operating section 47 detects selection, instruction, or the like given by the user and transmits it to the control section 41. The control section 41 performs control operation in accordance with the received instruction, or the like. For example, the control section 41 causes the operating section 47 realized by a liquid crystal touch panel, or the like to display necessary information thereon. Further, for example, the control section 41 outputs a document supply start signal to the document tray 22 in response to an instruction for reading of a document on the document tray 22, which is entered to the operating section 47 by the user.

Further, the control section 41 controls operations of the CIS 21 and the optical reading section 7 both as a reading section. Further, the control section 41 stores image data which are read by the CIS 21 or the optical reading section 7 into a memory (not shown). The reading operation by the control section 41 will be described later.

Further, the image reading device 2, as illustrated in FIG. 3, is provided with a document transport motor 43 for actuating the rollers R1 through R10. The image reading device 2 is further provided with a catching clutch 44, a first resist roller clutch 45, a second resist roller clutch 46, and other members, which are those for transferring a driving force generated by the document transport motor 43 to intended rollers.

The catching clutch 44 is a clutch for transferring the driving force to the catching roller R1 and the separation roller R2 which is coupled to the catching roller R1 by a transfer part such as a belt. The first resist roller clutch 45 is a clutch for transferring the driving force to the resist roller R8. The second resist roller clutch 46 is a clutch for transferring the driving force to the resist roller R3. Further, the image reading device 2 is provided with clutches (not shown) for actuating the rollers R2, R5, R6, R10, and others.

The control section 41 engages or disengages the clutches so that the driving force generated by the document transport motor 43 is transferred or interrupted with respect to the corresponding rollers. For example, in the state where disengagement of the clutch stops rotating the resist roller and its counter roller, the document is delivered and meets with the resist roller and the counter roller, which makes the document in a bowed state. Then, one side of the leading end of the document is brought along a joint of the resist roller and the counter roller, whereby a displacement of the document in the document transport direction is corrected so that skewing of the document is straightened. Thereafter, engagement of the clutch rotates the resist roller and the counter roller, thereby transporting the document.

Figure 5:
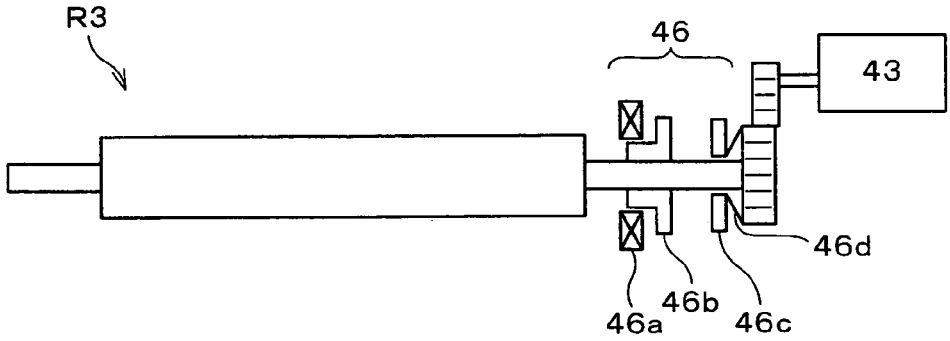
FIG. 5(*a*) is a plane view illustrating one example of a transport roller provided in the image forming device.
Figure 5:
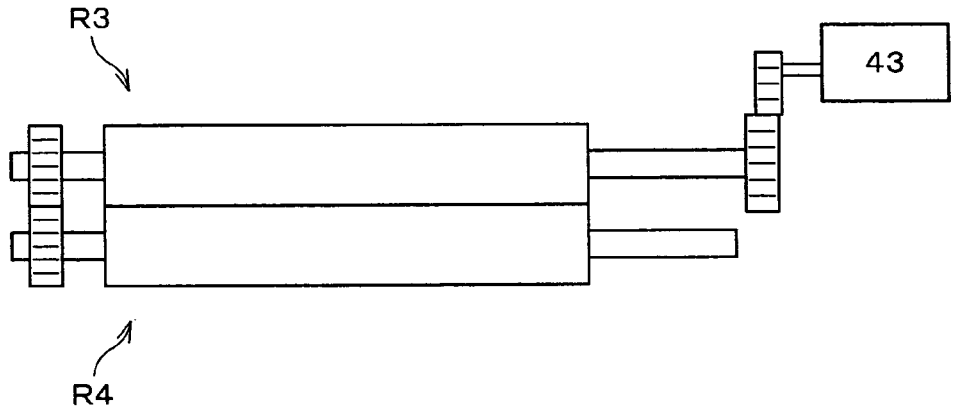

Here, as one example, the resist roller R3 and the second resist roller clutch (clutch) 46 are described with reference to FIG. 5(*a*) and FIG. 5(*b*). As illustrated in FIG. 5(*a*), to the resist roller R3, the driving force of the document transport motor 43 is transferred via the clutch 46. The clutch 46 of the present embodiment is an electromagnetic clutch. The clutch 46 includes a coil 46*a*, a friction section 46*b*, a magnetic material 46*c*, and a plate spring 46*d*.

When the control section 41 turns on the clutch 46, a current passes through the coil 46*a*, attracting the magnetic material 46*c*. The magnetic material 46*c* attached via the plate spring 46*d* to a gear and the coil 46*a* are attracted to each other, thereby pressing the friction section 46*b* against the gear. Pressing of the friction section 46*b* against the gear causes no slip between the friction section 46*b* and the gear. This transfers the driving force of the document transport motor 43 to the resist roller R3 via the clutch 46, which rotates the resist roller R3. On the other hand, when the control section 41 turns off the clutch 46, the gear to which the plate spring 46*d* is attached does not come into contact with the friction section 46*b*, causing slip between the gear and the friction section 46*b* and causing no rotation of the resist roller R3.

Note that, since the arrangement involving other clutches and rollers (e.g. the first resist roller clutch 45 and the resist roller R8) is the same as the foregoing arrangement, explanations thereof are omitted here. Further, the arrangement of the clutches adopted in the present embodiment, which is not limited to the foregoing arrangement, may be any arrangement provided that it can obtain the same effect as the effect produced by the foregoing arrangement.

Further, the resist roller R3 and the roller R4 in the present embodiment, as illustrated in FIG. 5(*b*), are connected to each other with gears. Note that, in FIG. 5(*b*), the illustration of the clutch 46 is omitted for the purpose of simplification. With this arrangement, the occurrence of slip in transporting the document through the resist roller R3 and the roller R4 can be prevented as compared with an arrangement in which the roller R4 is provided as merely a driven roller, for example. Hence, it is possible to precisely adjust a timing control, a paper feed accuracy, and others, without the occurrence of slip.

Further, shapes of the resist roller R3 and the roller R4 correspond to the whole width of a document usable in the image reading device 2. With this arrangement, positioning of the document is reliably performed when the document meets with the joint (nip section) of the resist roller R3 and the roller R4, for example. Moreover, it is possible to reliably perform positioning of the document regardless of a size of the document. Further, the resist roller R8 and the roller R9, having the same arrangement as that of the resist roller R3 and the roller R4, can obtain the same effect as the effect produced by the arrangement of the resist roller R3 and the roller R4.

Figure 7:
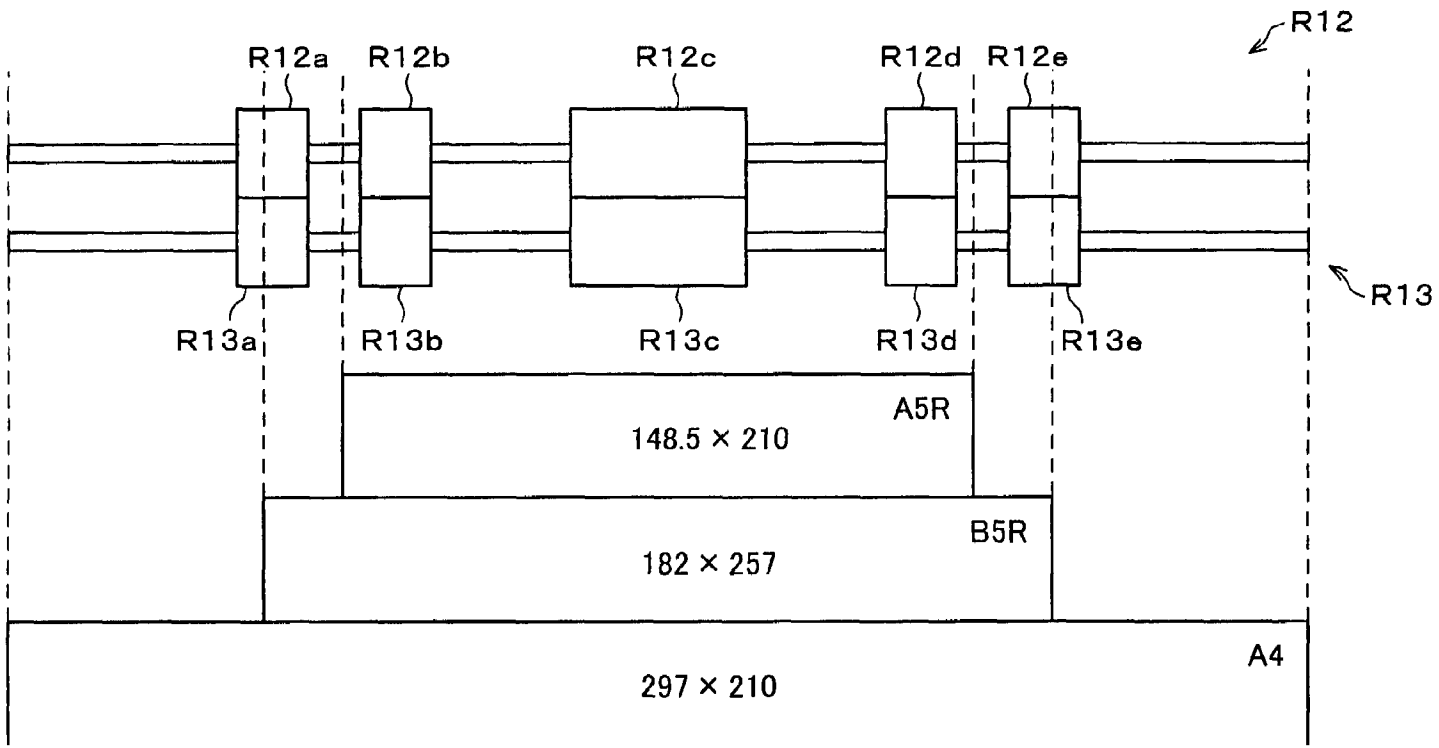
FIG. 7 is a plane view illustrating one example of a transport roller and a driven roller which are different from those illustrated in FIG. 5(*b*).

Further, the arrangement of the resist roller, which is not limited to the foregoing arrangement, may be any arrangement provided that it can obtain the same effect as the effect produced by the foregoing arrangement. For example, as illustrated in FIG. 7, the structure of split rollers may be adopted. Note that, in FIG. 7, clutches and a document transport motor are omitted for the purpose of simplification.

More specifically, instead of the resist roller R3 and the roller R4, a resist roller R12 and a roller R13, as illustrated in FIG. 7, respectively provided with split rollers R12*a* through R12*e* and split rollers R13*a* through R13*e*, i.e. structure of five-part split roller may be adopted.

For example, in the case of a document of B5 Japanese paper (short side is 182 mm, and long side is 257 mm) among documents frequently used in the multifunction device 1, in a situation where the document is placed in such a manner that its short side is parallel to a main scanning direction, the split rollers R12*a* through R12*e* and the split rollers R13*a* through R13*e* are arranged in such a manner that corners of the document meet with the split rollers R12*a*, R13*a*, R12*e*, and R13*e*, which are arranged at the both ends of the resist roller R12 and the roller R13. Thus, the structure of split rollers also enables reliable correction of skewing of the document as long as the split rollers are arranged in such a manner that corners of the document having a size frequently used meet with the split rollers (the corners are in place in the area of the split rollers).

Further, in the case of a document of A5 Japanese paper (short side is 148.5 mm, and long side is 210 mm), which is small in size, among documents frequently used in the multifunction device 1, in a situation where the document is placed in such a manner that its short side is parallel to the main scanning direction, the split rollers R12*a* through R12*e* and the split rollers R13*a* through R13*e* are arranged in such a manner that the three split rollers R12*b* through R12*d* and the three split rollers R13*b* through R13*d* are in place in the area of the document. Thus, even when a document of small size is placed so that its short side is parallel to the main scanning direction, skewing of the document can be reliably corrected as long as at least three split rollers are arranged within the area of the document.

For example, in the case of a document of A4 Japanese paper (short side is 210 mm, and long side is 297 mm) among documents frequently used in the multifunction device 1, in a situation where the document is placed in such a manner that its long side is parallel to the main scanning direction, the split rollers R12*a* through R12*e* and the split rollers R13*a* through R13*e* are arranged so as to be in place in the area of the document of this size.

Note that, in the resist roller R12 and the roller R13, for realization of an increased transport force in the central part of the resist roller R12 and the roller R13, the wide rollers R12*c* and R13*c* are placed in the central part of the resist roller R12 and the roller R13. This arrangement is adopted to overcome a load in the central part of the resist roller R12 and the roller R13, which is caused by a reversing force of the separation roller R2*a* of the separation rollers R2 and R2*a*.

Figure 6:
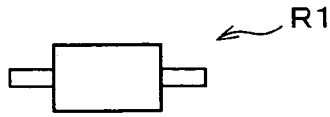
FIG. 6(*a*) is a plane view illustrating one example of another transport roller provided in the image forming device.
Figure 6:
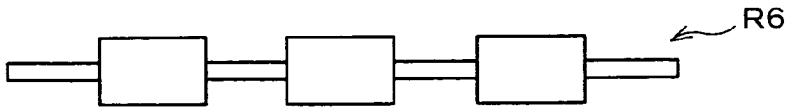

Further, instead of the resist roller R8 and the roller R9, for example, a four-part split roller as well as a three-part split roller R6 illustrated in FIG. 6(*b*) may be adopted.

Note that, the catching roller R1 for picking up a document has a shape of roller only in the part where the central part of the document comes into contact with the catching roller R1. Further, the catching roller R1 usually has a short shaft. Still further, a roller, for example, like the roller R6 for transporting the document, as illustrated in FIG. 6(*b*), has an arrangement such that three small rollers are arranged at a distance from one another, not an arrangement in which a single roller is provided corresponding to the width of the document.

Further, in the present embodiment, the arrangement in which the image reading device 2 is provided with one motor as a drive source, and a driving force of the motor is transferred to each roller via a clutch has been described. However, the present invention is not limited to this arrangement. Alternatively, for example, the arrangement in which a motor is provided for each roller may be adopted. In either case, it is safe that a desired document transport is realized by properly controlling the rotation speed of the motor.

To perform control operation, the control section 41 acquires sets of information (detection results) from the above-described following members: first and second document size detectors S0 and S7; catching roller position detector S2; paper feed detectors S3, S4, and S5; paper feed detector S6; light source unit detector S8; and third document size detector S9 illustrated in FIG. 3. For example, the control section 41 switches the type of sheet used in the image forming device 3 and control of paper feeding timing, and others. Note that, the third document size detector S9 is one for detecting the size of a document placed on the document stage 12.

As described above, the control section 41 controls each of the means in the image reading device 2, thereby performing document transport and image reading.

Next, image reading by the optical reading section 7 and the CIS 21 in the image reading device 2 will be described in detail. As described previously, selectable modes in the image reading device 2 are the following three modes: static reading mode, scanning reading mode, and two-sided reading mode.

The optical reading section 7 is used in any mode of the static reading mode, the scanning reading mode, and the two-sided reading mode. The optical reading section 7 includes the CCD reading unit 11, the document stage 12, the light source unit 13, the mirror unit 14, and a document stage 16.

The CCD reading unit 11 is provided with an image focus lens 11*a* and a CCD 11*b*. In the CCD reading unit 11, an incoming document image through the light source unit 13 and the mirror unit 14 is focused via the image focus lens 11*a* on the CCD 11*b*. Image data obtained by the CCD 11*b* is stored in a memory (not shown) by the control section 41.

Note that, the CCD reading unit 11 may be arranged so as to be a minification reading optical system unit (or contact type reading optical system unit) which is one unit including at least the image focus lens 11*a*, the CCD 11*b*, and the light source 13*a* like an exposure lamp, wherein the image focus lens 11*a* focuses, on the CCD 11*b*, reflection light corresponding to a document with respect to light emitted from the light source 13*a* while scanning in a sub-scanning direction indicated by an arrow 15.

The document stage 12, which is made of platen glass, is a stage on which a document such as book is placed so that the optical reading section 7 can read an image of the document. The document stage 16 is provided separately from the document stage 12, at a distance from the document stage 12 in the sub-scanning direction.

The light source unit 13 includes the light source 13*a*, a reflector 13*b*, a slit 13*c*, and a mirror 13*d*. The light source 13*a* is, for example, an exposure lamp which generates light which is projected to a document to be read. The reflector 13*b* is a concave reflection member that focuses illumination light for reading, which is emitted from the light source 13*a*, on a predetermined reading position provided on the document stage 12. The slit 13*c* is a member for passing only the reflection light from the document. The mirror 13*d* is one for changing a light path of the light having passed through the slit 13*c* by 90 degrees, and the mirror 13*d* is installed so that its reflection surface is at an angle of 45 degrees with respect to the surface of the document stage 12.

The mirror unit 14 is one for guiding the reflected light of the document coming from the light source unit 13 to the CCD reading unit 11. The mirror unit 14 includes a pair of mirrors 14*a* and 14*b*. The mirrors 14*a* and 14*b* are arranged so that their reflection surfaces are orthogonal as to be orthogonal to each other, so as to further change, by 180 degrees, a light path of the light having been changed its light path by 90 degrees by the mirror 13*d* of the light source unit 13.

Here, the light source unit 13 is movable in the sub-scanning direction (the direction indicated by the arrow 15 illustrated in FIG. 1), and performs reading while moving in the sub-scanning direction in the static reading mode of the image reading device 2.

Further, in the static reading mode, the ADF 6 is opened by moving upwards from the state illustrated in FIG. 1. With this arrangement, an upper surface of the document stage 12 of the image reading device 2 can be opened from the front side in FIG. 1, so that a document incapable of being transported by the ADF 6, such as a book and a bound document, can be set on the document stage 12.

On this account, the ADF 6 is supported so as to move on a hinge (not shown) provided between the ADF 6 and the optical reading section 7 at the back of the image reading device 2 (at the back of the drawing). The ADF 6 is opened by moving upwards on this hinge with respect to the document stage 12. Note that, the ADF 6 is provided with a document mat 35 on its bottom surface, i.e. a surface facing the document stage 12, and the document mat 35 is made of elastic material.

In reading a document on the document stage 12, the light source unit 13 moves a predetermined distance in accordance with a document size detected by the document size detector (not shown) for detecting the size of a document placed on the document stage 12 in the direction heading from a position P3 (light source unit 13's starting position of static reading) to a position P4 (light source unit 13's return position of reading the largest document).

More specifically, under the control of the control section 41, the light source unit 13 moves in the direction of the arrow 15 in FIG. 1, which is parallel to the surface of the document stage 12, as indicated by reference numerals 13*e* and 13*f* in FIG. 1. In a similar manner, the mirror unit 14 also moves in the direction of the arrow 15 under the control of the control section 41. This makes it possible to read an image of a document placed on the document stage 12. Note that, the movement of the light source unit 13 and the mirror unit 14 is performed in such a manner that the control section 41 controls actuation of a stepping motor 42. The mirror unit 14 moves at half speed of the light source unit 13. Further, the control section 41 controls the light source 13*a* and the CCD 11*b* in accordance with the position of the light source unit 13 detected by the light source unit detector S8.

In reading a document being transported in the scanning reading mode and the two-sided reading mode, the light source unit 13 stops and performs reading at a position represented by the light source unit 13 in FIG. 1 (position P1). In this state, the light source unit 13 is capable of reading an image on one surface (hereinafter referred to as "front surface") of the document being transported on the document stage 16.

Note that, as illustrated in FIG. 1, the light source unit 13 determines its home position to either a midpoint position between the position P3 represented by the light source unit 13*e* and the position P4 represented by the light source unit 13*f* or a midpoint position between the position P1 represented by the light source unit 13 and the position P3 represented by the light source unit 13*e*, in accordance with a detection result of the light source unit detector S8 illustrated in FIG. 3, which is a position detector of the light source unit 13. Therefore, during periods of non-use of the light source unit 13, i.e. during standby, the light source unit 13 is in a state of stopping at this home position.

Meanwhile, the CIS 21 is provided on the side of the ADF 6 at a position opposite to the document stage 16 of the optical reading section 7. The CIS 21 is used in the two-sided reading mode of the image reading device 2. The ADF 6 lets in documents placed in a stacked manner on the document tray 22 one by one, so that the CIS 21 reads an image on the other surface (hereinafter referred to as "back surface") of the document, as described previously. Note that, the CIS 21 is provided with, for example, image sensors arranged in an array manner and a light guiding section (lens array such as SELFOC® lens) and a light source (LED array light source or fluorescent lamp), and other components.

The control section 41 controls the document transport motor 43, the catching clutch 44, the first resist roller clutch 45, the second resist roller clutch 46, and others in accordance with detection results of the detectors S3 through S6, so as to perform transport of the document placed on the document tray 22. Further, the control section 41 controls the CCD 11*b* and the CIS 21 so as to read the image of the document. The control section 41 controls actuation of the up and down motor 33 so as to hold the uppermost document of a batch of documents placed on the document tray 22 at a given level in accordance with a detection result of the catching roller position detector S2. The control section 41 repetitively performs the aforementioned operation for each document until the document detector S1 detects that all the documents placed on the document tray 22 are gone.

Figure 4:
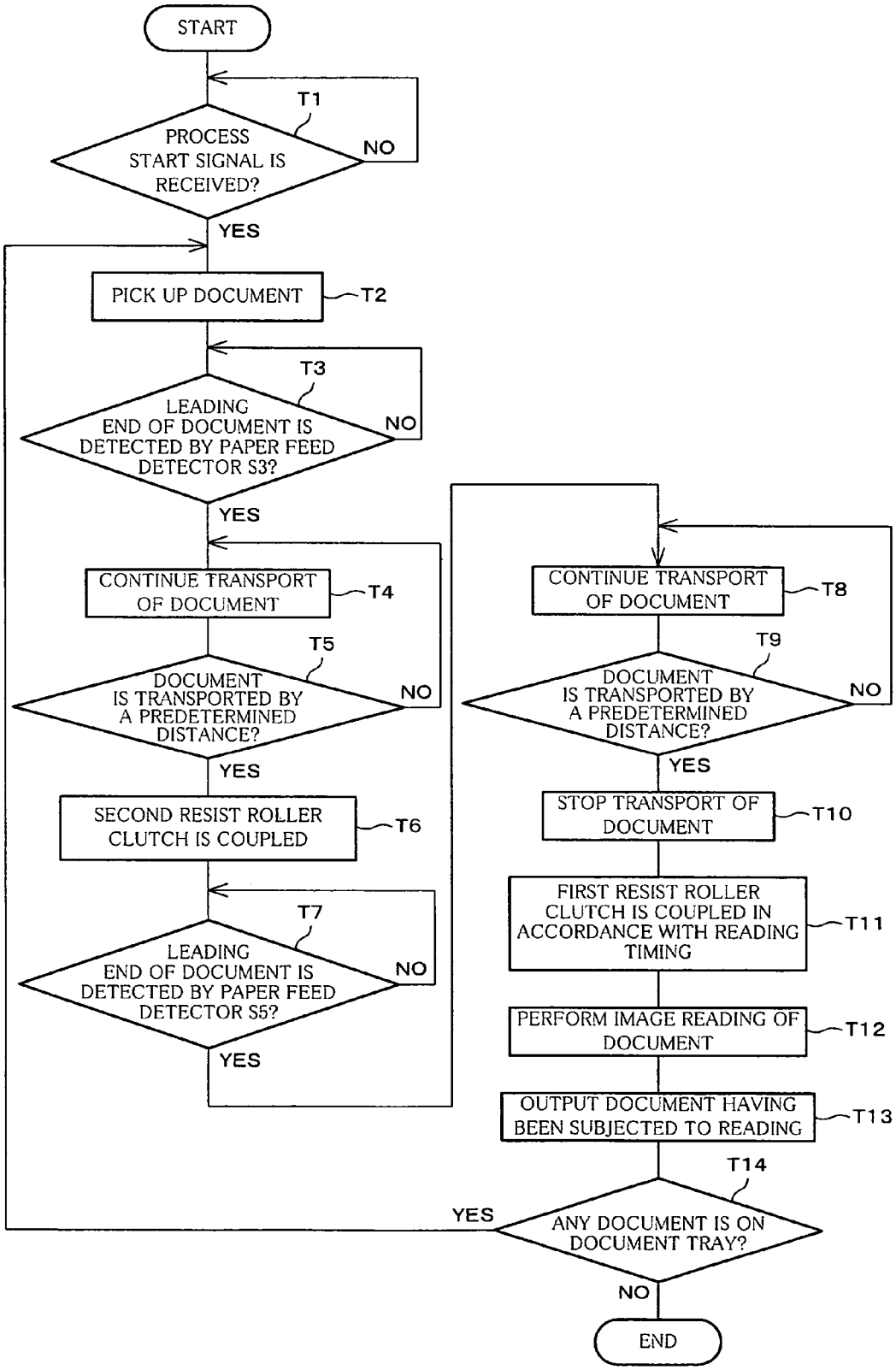
FIG. 4 is a flowchart illustrating one example of a process in the image reading device.

Here, the following will describe reading operation using the ADF 6 by the image reading device 2 with reference to a flowchart of FIG. 4.

When a document is placed on the document tray 22, the image reading device 2 starts a process for reading the document, adjusts the position of the document tray 22 as described previously, and enters the standby state. In Step T1, it is determined whether a process start signal is received or not. If the process start signal is detected, the process goes to Step T2. If the process start signal is not detected, Step T1 is repeated.

In Step T2, the catching roller R1 picks up the document on the document tray 22, and the process goes to Step T3. In Step T3, it is determined whether or the leading end of the document is detected by the paper feed detector S3. If the leading end is detected, the process goes to Step T4. If the leading end is not detected, Step T3 is repeated.

In Step T4, transport of the document is continued in the transport path, and the process goes to Step T5. In Step T5, the document is transported by a predetermined distance so that the transported document meets with the resist section (second resist section) consisting of the resist roller R3 and the roller R4. At this moment, the resist roller R3 and the roller R4 are stopped rotational motion. If the document is transported by the predetermined distance, the process goes to Step T6. If not, the process goes back to Step T4.

In Step T6, the second resist roller clutch 46 is coupled to the resist roller R3. This rotates the resist roller R3 and the roller R4, feeding the document to the curved section 23. The document is sequentially transported by the rollers through the curved section 23 in the transport path. After performing Step T6, the process goes to Step T7.

In Step T7, it is determined whether or not the leading end of the document is detected by the paper feed detector S5 provided in front of the first resist section consisting of the resist roller R8 and the roller 9. If the leading end of the document is detected, the process goes to Step T8. If the leading end of the document is not detected, Step T7 is repeated.

In Step T8, transport of the document is continued in the transport path, and the process goes to Step T9. In Step T9, the document is transported by a predetermined distance so that the transported document meets with the first resist section consisting of the resist roller R8 and the roller R9. At this moment, the resist roller R8 and the roller R9 are stopped rotational motion. If the document is transported by the predetermined distance, the process goes to Step T10. If not, the process goes back to Step T8. In Step T10, transport of the document is stopped, and the process goes to Step T11.

In Step T11, the first resist roller clutch is coupled to the resist roller R8 in accordance with a predetermined reading timing so that the document is delivered to the image reading region made up of the optical reading section 7 and the CIS 21. This causes the rotational motion of the resist roller R8 and the roller R9, so that the document is delivered to the image reading region.

In Step T12 following Step T11, the image of the document is read by the optical reading section 7 and the CIS 21, and the process goes to Step T13. In Step T13, the document having been read is outputted to the output tray 17 by the output roller R10 and the roller R11, and the process goes to Step T14. In Step T14, it is determined whether or not any document (unprocessed document) is placed on the document tray 22. If unprocessed document remains on the document tray 22, the process goes back to step T2. If no unprocessed document remains on the document tray 22, the process is ended.

As described above, the image of the document placed on the document tray 22 can be read by using the ADF 6 and the optical reading section 7 in the image reading device 2. Image data of the document having been read is transmitted to the image forming device 3 so that the image forming device 3 can print the image data.

Note that, the resist roller R8 is actuated in accordance with the reading timing in Step T11. Further, actuation of the resist roller R3 in Step T6 is taken into account a timing in Step T11 which occurs after the transport of the document, and the document is delivered to be in time for the timing in Step T11. As described previously, the resist roller R3 and the resist roller R8 may have the same structure. What the controls of the resist roller R3 and the resist roller R8 have in common is that after rotational motion is stopped temporarily to resist the document, the rotational motion is restarted at a predetermined timing.

Note that, the description with reference to FIG. 4 has been given based on the arrangement in which the number of document included in the transport path of the ADF 6 is only one. However, the present invention is not limited to this arrangement, and a plurality of documents separated from each other may be simultaneously included in the transport path. In such a case, it is natural that the documents are sequentially transported one by one to the image reading region so that images of the documents can be read.

The following will describe printing using the image forming device 3. The image forming device 3 performs image forming on a sheet of paper supplied from the sheet supply device 4, or the like in accordance with image data obtained in such a manner that the image of the document is read by the image reading device 2, or image data transferred from an external information processor (not shown).

In the image forming device 3 of the multifunction device 1, as described previously, the control section 41 is installed for causing the members of the multifunction device 1 to operate in a coordinated fashion, so as to perform image forming on a sheet of paper supplied from the sheet supply device 4 to the image forming device 3 in accordance with the image of the document having been read by the image reading device 2.

Further, the image forming device 3 is provided with a paper tray 51 and a manual tray 54. The manual tray 54 is a tray for delivering an arbitrary sheet of paper from outside thereinto. A sheet of paper supplied from the paper tray 51 or the manual tray 54 is transported through a transport path 56 to an image transfer region (processing region) including a photoconductive drum 59, a transfer unit 62, and others provided therein, and the image of the document is transferred to the sheet of paper. Thereafter, the transferred image is fused on the sheet of paper by a fusing device 66.

The sheet supply device 4 which is placed under the image forming device 3 is provided with a transport path 50 communicating with the transport path 56 in the image forming device 3, and paper cassettes 52 and 53. The paper cassettes 52 and 53 are cassettes capable of containing the large amount of sheets of paper therein. Each of the paper cassettes 52 and 53 contains sheets of paper of different size.

Further, the image forming device 3 is provided with a switchback path 68 on the downstream side of the fusing device 66 in a paper transport direction, and the switchback path 68 is used for performing image forming on the back surface of the sheet of paper. The sheet of paper reversed by the switchback is supplied to the transport path 56 through a two-sided unit 55. Note that, the switchback path 68 and the two-sided unit 55 are used not only in performing image forming on the two sides of the sheet of paper, but also in outputting the sheet of paper turned upside down.

Further, the image forming device 3 is provided with a pair of rollers 57*c* and 57*d* (second resist section) as a resist section in the transport path 56. The sheet supply device 4 is provided with a pair of rollers 57*a* and 57*b* (secondary resist section) as a resist section in the transport path 50.

The sheet of paper guided from the paper tray 51 or the two-sided unit 55 to the transport path 56 using a catching roller is resisted by the pair of rollers 57*d* and 57*c* placed in the transport path 56, and thereafter the sheet of paper is transported toward the image transfer region through the transport path 56. The sheet of paper guided by the catching roller from the paper cassettes 52 and 53 to the transport path 50 is temporarily resisted by the pair of rollers 57*b* and 57*a* which are placed in the transport path 50, and thereafter, transported toward the image transfer region through the transport paths 50 and 56 by the pair of rollers placed in the transport paths 50 and 56. That is, the sheet of paper is transported to the image transfer region after having been subjected to skewing correction.

Further, the transport path 56 is provided with a pair of rollers as a resist section (first resist section, primary resist section) 58 in front of the image transfer region. With this arrangement, skewing of a sheet of paper is prevented in printing, and a timing of supplying a sheet of paper is adjusted.

Here, the following will describe a process in the image transfer region. For example, image data having read by the image reading device 2 is delivered to an image processing section (not shown) and is subjected to a predetermined image processing therein, and the image data is then stored temporarily in an image memory inside the image processing section. Subsequently, the image data is read sequentially from the image memory at a predetermined timing and transferred to the laser writing unit 60 which is an optical writing device.

The laser writing unit 60 includes a semiconductor laser light source (not shown), a polygon mirror, f-θ lens, and others. The semiconductor laser light source emits laser light beams in accordance with image data transferred from the image memory. The polygon mirror deflects the laser light beams at a constant angular velocity. The f-θ lens performs correction so that the laser light beams having been deflected at a constant angular velocity is deflected at a constant angular velocity on a photoconductive drum 59. Note that, in the present embodiment, the laser writing unit is used as the optical writing device. Alternatively, an optical writing head unit of fixed-scanning type using a light-emitting array such as LED (Light Emitting Diode) and EL (Electro Luminescence) may be used as the optical writing device.

In the periphery of the photoconductive drum 59, a charger unit 65, a developer unit 61, a transfer unit 62, a discharger unit 63, and a cleaner unit 64 are placed. The charger unit 65 causes the photoconductive drum 59 to electrically charge at a predetermined potential. The developer unit 61 supplies a toner (developer) to an electrostatic latent image formed on the photoconductive drum 59 to develop the image. The transfer unit 62 transfers the toner image formed on the surface of the photoconductive drum 59 onto a sheet of paper transferred. The discharger unit 63 discharges electric charges from the sheet of paper on which the toner image is transferred, and the sheet of paper is taken off the photoconductive drum 59. The cleaner unit 64 collects a residual toner remaining on the photoconductive drum 59 after the toner image has been transferred.

The sheet of paper is delivered by the pair of rollers 58 at a predetermined timing to a developer image on the photoconductive drum 59, and the developer image is transferred to the sheet of paper by the transfer unit 62. The sheet of paper having been transferred the image thereon is transported to the fusing device 66, and the fusing device 66 fuses the image on the sheet of paper. The sheet of paper having been fused the image thereon is outputted to outside of the image forming device 3 by the paper output roller 67.

The finishing device 5 which performs processes, such as stapling and folding, with respect to the sheet of paper on which the image is formed is provided on the downstream side of the paper output roller 67 in the sheet transport direction. The sheet of paper guided to the finishing device 5 is outputted on the up and down tray 69 after having been subjected to a predetermined finishing process.

As described above, the multifunction device 1 according to the present embodiment includes the image reading device 2 and the image forming device 3 as a sheet transport device having a plurality of resisting means in a transport path of a sheet (document, sheet of paper). The sheet supply device 4 having resisting means in a transport path through which only a sheet is transported. This makes it possible to correct skewing of a sheet in transporting the sheet.

Here, functions of the resist section are timing adjustment and skewing correction. For the skewing correction, the leading end of the sheet delivered is met with the resist roller stopped rotational motion so as to be bought along the resist roller.

However, if a very large displacement of the sheet occurs, the displacement of the sheet might not be completely straightened even with the resist roller. Further, when the sheet not being completely straightened reaches the processing section, the image is skewed.

In view of this, the present invention provides a resisting function to rollers that conventionally just serving as transport rollers. That is, the rollers in the midway of the transport path which are conventionally used only for transport serve as resist rollers. With this arrangement, a displacement of the sheet is corrected once in the midway of the transport path, so that a very large displacement of the sheet does not occur.

Note that, in the present embodiment, the description of the resist section which performs resisting operation has been based on roller-type resist sections such as the resist roller R3, the roller R4, the resist roller R8, and the roller R9. However, the present invention is not limited to this arrangement. For example, gate-type resist sections may be used. For example, the gate-type resist section is made up of: a gate provided openably/closably in the transport path; and rollers (slip roller, weight roller) correcting a displacement of the sheet when the gate is closed. A displacement of the sheet in the sheet transport direction can be corrected in such a manner that the rollers are activated with the sheet met with the closed gate. By opening the gate, transport of the sheet is started.

As described above, the present invention relates to a sheet supply device (sheet transport device) which supplies and transports a document, or the like and reads an image of the document, and an image reading device and image forming device including the sheet supply device.

Conventionally, in the case where the processing section is an image reading section or an image forming section, the resist section was provided only in front of the processing section performing a process.

In recent years, with advance of digital technology, reading from a document, conversion into electronic data, and image formation from electronic data is getting faster. On this account, a greater number of documents can be processed at high speed.

For example, an image reading device provides a tray capable of placing a great number of documents, about 100 sheets to 200 sheets, at a time thereon. Further, with advance of a document transport section in a document reading device, various types of a document that can be transported are increased. Further, in a large number of sheets stacked on the tray, the sheet from the top is sequentially delivered to the transport path. More specifically, in an image reading device or the like which supplies and transports a large number of sheets such as documents as described above and reads the images of the documents, the capacity of documents that can be placed is large, and a large number of documents can be stacked. In supplying the stacked documents one by one to the reading section, delivering the documents from the bottom is difficult because the documents are affected by the weight of all documents stacked. Therefore, generally used is a way of delivering the documents from the top because the documents are not affected by the weight of all documents stacked.

In this case, the position where the tray is placed is determined in accordance with demand for size reduction of the device. Because of this, the arrangement in which the document is transported through a transport path curved from the position of the tray to a document reading position is used.

However, a long transport path through which a sheet such as a document is supplied and transported is likely to cause a skew of the document in the middle of transport of the document in the transport path, and reading an image on the skewed document causes such a trouble that the image of the document is kept skewed, or that a portion of the image is unreadable, causing degradation in quality of reading. In view of this, as described above, the resist section for adjusting a reading timing as well as straightening a skew of the document is normally provided in front of the reading section (just before the reading section).

The skew occurred when a sheet such as a document is supplied and transported occurs when the document is picked up from the tray on which the document is placed and during a period of time in which the document is transported in the transport path. For pick-up of the document, a narrow pick-up roller is used in the central part of the document to support various sizes of the document, so that the document is more likely to be skewed when it is picked up due to a state of the document in itself and instability (variations) of contact load between the documents. In the case where the document is transported in the transport path, a skew occurs due to a size error of transport means (transport roller) provided in the transport path and instability (variations) of contact load of a transport guide.

In the case where the transport path is curved, the skew is more likely to occur. Further, a skew of a sheet such as a document transported can be straightened in the resist section. However, the amount of skew that can be straightened is limited depending on the amount of bending of the sheet when the skewed document is straightened, and the skew might not be completely straightened. Especially, in the case where a curved transport path is provided on the upstream side of the resist section in the transport direction, the amount of the skew that can be straightened becomes smaller depending on firmness of the bent sheet.

Further, there is the problem that the skew is not completely straightened because of the problem that a resist region where bending of the sheet is formed cannot be widely provided on the upstream side of the resist section in the transport direction since size reduction of the device is demanded.

The present invention is attained in view of these problem, and as described above, an embodiment of the present invention provides a sheet supply device where a skew of a sheet can be straightened almost completely in such a manner that the resist sections are provided at a plurality of positions before the region where the sheet such as document is picked up, is transported through the transport path, and is subjected to a process such as reading, and where transporting and processing with high quality can be performed, and an image reading device (image forming device) including the sheet supply device.

Embodiments of the invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image forming device comprising:

a transport path through which a sheet is transported, the transport path including a curved section having a curved shape, the curved section changing a transport direction of the sheet to be transported the transport path also including: a processing region for a processing section which performs a predetermined process with respect to the sheet; and a transport region for transporting the sheet to the processing region;

a first resist section, provided in the transport region, correcting at least skewing of the sheet and delivering the sheet to the processing section in accordance with a timing of the process in the processing section; and a second resist section, provided in the transport region, correcting skewing of the sheet, wherein, out of the transport region and the processing region included in the transport path, a sheet being transported along the transport path from the second resist section to the first resist section passes through only the transport region, the curved section is provided between the first resist section and the second resist section and the second resist section performs a first resist correction of the sheet before a leading edge of the sheet enters the curved section, and the processing section is an image forming section which forms an image on the sheet.

2. A sheet transport device comprising:

a transport path through which a sheet is transported, the transport path including a curved section having a curved shape, the curved section changing a transport direction of the sheet to be transported, the transport path also including: a processing region for a processing section which performs a predetermined process with respect to the sheet; and a transport region for transporting the sheet to the processing region;

a first resist section, provided in the transport region, correcting at least skewing of the sheet and delivering the sheet to the processing section in accordance with a timing of the process in the processing section; and a second resist section, provided in the transport region, correcting skewing of the sheet, wherein, out of the transport region and the processing region included in the transport path, a sheet being transported along the transport path from the second resist section to the first resist section passes through only the transport region; and wherein the curved section is provided between the first resist section and the second resist section and the second resist section performs a first resist correction of the sheet before a leading edge of the sheet enters the curved section.

3. The sheet transport device according to claim 1, wherein:

the first resist section is provided on a downstream side of the curved section in the transport direction of the sheet, at a distance from the curved section, and the second resist section is provided on an upstream side of the curved section in the transport direction of the sheet, at a position just before the curved section.

4. The sheet transport device according to claim 1, wherein:

the second resist section is provided at an upstream position of a flow of the sheet with respect to the first resist section in the transport path.

5. The sheet transport device according to claim 4, wherein:

the first resist section is provided on a downstream side of the curved section in the transport direction of the sheet, at a distance from the curved section, and the second resist section is provided on an upstream side of the curved section in the transport direction of the sheet, at a position just before the curved section.

6. A sheet transport device, which is connected to a processing device including a processing section which performs a predetermined process with respect to a sheet, including: a transport path through which the sheet is transported to the processing section, the transport path including a curved section having a curved shape, the curved section changing a transport direction of the sheet to be transported; and a primary resist section, provided in the transport path, correcting at least skewing of the sheet and adjusting a delivery timing of the sheet, and supplying the sheet to the processing section by means of the primary resist section, the sheet transport device comprising:

a secondary resist section correcting skewing of the sheet, provided at an upstream position in a flow of the sheet with respect to the primary resist section in the transport path, the transport path extending from the second resist section to the primary resist section without passing through any processing section, wherein the curved section is provided between the primary resist section and the secondary resist section and the secondary resist section performs a first resist correction of the sheet before a leading edge of the sheet enters the curved section.

7. An image reading device comprising:

a transport path through which a sheet is transported, the transport path including a curved section having a curved shape, the curved section changing a transport direction of the sheet to be transported, the transport path also including: a processing region for a processing section which performs a predetermined process with respect to the sheet; and a transport region for transporting the sheet to the processing region;

a first resist section, provided in the transport region, correcting at least skewing of the sheet and delivering the sheet to the processing section in accordance with a timing of the process in the processing section; and a second resist section, provided in the transport region, correcting skewing of the sheet, wherein, out of the transport region and the processing region included in the transport path, a sheet being transported along the transport path from the second resist section to the first resist section passes through only the transport region, the curved section is provided between the first resist section and the second resist section and the second resist section performs a first resist correction of the sheet before a leading edge of the sheet enters the curved section, and the processing section is an image reading section which reads an image of the sheet.

8. A sheet transport device comprising:

a sheet feeder, a processing section comprising an image reading section or an image forming section;

a transport path from said sheet feeder to said processing section, the transport path including a curved section having a curved shape, the curved section changing a transport direction of the sheet to be transported, said transport path not including an image reading section or an image forming section;

a first resist section provided in the transport path between the sheet feeder and the processing section; and a second resist section provided in the transport path between the first resist section and the sheet feeder, wherein the curved section is provided between the first resist section and the second resist section and the second resist section performs a first resist correction of the sheet before a leading edge of the sheet enters the curved section.

* * * * *